United States Patent [19]

Rouse

[11] 4,277,069

[45] Jul. 7, 1981

[54] ARROW FOR BLOOD TRACKING

[76] Inventor: Michael F. Rouse, Rte. 3, Blair, Nebr. 68008

[21] Appl. No.: 27,072

[22] Filed: Apr. 4, 1979

[51] Int. Cl.[3] ..... F41B 5/02

[52] U.S. Cl. ..... 273/418

[58] Field of Search ..... 273/106.5 R, 418–423; 128/221, 347, 348; 27/24 R, 24 A

[56] References Cited

U.S. PATENT DOCUMENTS

| | | | |
|---|---|---|---|
| 2,467,838 | 4/1949 | Lust et al. | 273/418 |
| 2,554,012 | 5/1951 | Cohen | 273/106.5 R |
| 3,617,060 | 11/1971 | Iezzi | 273/106.5 R |

*Primary Examiner*—Paul E. Shapiro

*Attorney, Agent, or Firm*—Hiram A. Sturges

[57] ABSTRACT

An arrow for blood tracking comprising an elongated tubular shank having a head at one end and a nock at its other end, the arrow having a plurality of holes extending therethrough from the exterior of the arrow, the inner ends of the holes being in communication with the interior of the shank so that blood can flow into the shank through one or more holes and out of the shank through one or more holes, the walls of the holes being slanted rearwardly toward their outer ends, at least one of the holes being in a mid-portion of the shank and there being at least one hole substantially spaced forwardly of the mid-portion hole and another substantially spaced rearwardly thereof.

4 Claims, 7 Drawing Figures

ARROW FOR BLOOD TRACKING

BACKGROUND OF THE INVENTION

The most humane hunting is provided when a deer or other animal can be captured as soon as possible after being wounded. If the animal can escape and not be found, then it can be in pain for great lengths of time in accordance with how it was hit. Hunting arrows now in standard use cause almost no blood track to be left for a hunter to follow for trailing a deer because the arrow shaft tends to plug up the opening made by the arrow.

The blood of a deer coagulates many, many times faster than that of a human being.

In years past there have been various proposals for the making of arrows capable of conducting blood from the inside of an animal to the outside so that the blood leaves a trail to be found by the hunter. None are on the market to my knowledge and this, in my opinion is due to various disadvantages in their construction.

Deer hunting with arrows is both a good sport and a way to bring meat to the table, but it is best if it can be done as humanely as possible.

Arrows of the prior art are intended for the escape of blood from an animal have had holes extending into the interior of tubular shafts, but the holes have been drilled at a right angle to the shafts. This tends to increase the possibility that the flesh of the animal may become crowded into the hole, stopping flow. Another disadvantage is noise.

Deer have acutely sensitive hearing and they can hear an arrow flying through the air and are much more likely to become alarmed if there is a whistling sound caused by holes in the shaft that extend at a right angle to the shaft.

To solve these two problems, I have conceived that in both cases, the problem is that the hole is at a right angle to the shaft, solvable by drilling the hole at a slant with the holes slanting to the rearward toward its outer end. This would make a arrow that would be more quiet and with less whistling to alarm a deer and, also, an arrow with holes less likely to be clogged with flesh.

Another disadvantage of arrows proposed for this purpose has been the absence of a hole or holes in a mid-section of the shaft. This may have been from the thought that the head of the shaft and a substantial part of the shaft might enter the deer, whereas the rearward end might not, so that blood entering at the head would escape out the rearward end of the shaft. But, in my opinion, more of the arrows are stopping in the deer in such a way that both the forward end and the rearward end of the arrow are outside the deer on opposite sides of the deer. When this happens, there is no blood flow through the arrow. Believing this to be a problem, I conceived of an arrow having holes near the ends of the arrow, but also one or more holes therebetween so that when an arrow is protruding from the deer, both at its head, and at its tail, the blood can flow through the hole at the center of the shaft and then spurt out each end of the shaft. This also increases the speed of blood loss which is desirable for humane recovery of the animal quickly without unnecessary pain and leaves an easier trail to follow.

SUMMARY OF THE INVENTION

An important object of this invention is to provide an arrow for blood tracking comprising an elongated tubular shank having a head at one end and a nock at its other end, the arrow having a pluralitly of holes extending therethrough from the exterior of the arrow, the inner ends of the holes being in communication with the interior of the shank so that blood can flow into the shank through one or more holes and out of the shank through one or more holes, at least one of the holes being in a mid-portion of the shank and there being at least one hole substantially spaced forwardly of the mid-portion hole and another substantially spaced rearwardly thereof.

Another important goal of this invention is to provide the concept of the blood tracking arrow in which holes from the exterior to the hollow shank slant rearwardly towards their outer ends whereby whistling is prevented so that the arrow can be relatively noiseless.

DESCRIPTION OF THE PREFERRED EMBODIMENT

Figure 1:
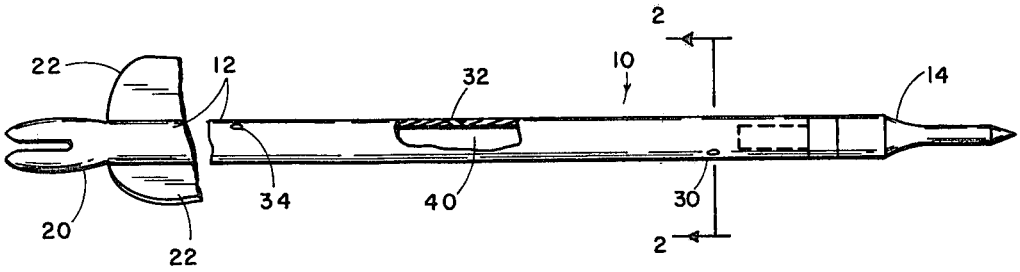
FIG. 1 is a side elevation of an arrow for blood tracking of this invention shown with a portion of the rearward part of the shank, including a portion of the feathers removed, the transverse dimension of the arrow being somewhat enlarged in proportion to its length for convenience of illustration, a portion of the center of the shank being removed.

Referring to FIG. 1 the blood tracking arrow of this invention is generally indicated at 10 and comprises an elongated tubular shank 12, having a head 14 at one end stabilizers are shown in FIG. 1 on a rearward end portion of the shank 12, and a nock 20 at the rearward end. In accordance with this invention, the arrow 10 has a plurality of holes 30, 32 and 34 extending therethrough and all of these are located in the shank 12 in the most preferred form of the invention, each hole extending from the exterior through the respective side of the tubular shank 12 to the hollow interior 40 thereof.

At least one of the holes 32 is in a mid-portion of the shank 12, and at least one other of the holes is substantially spaced forwardly of the mid-portion hole 32 and as seen at 30.

The third and rearward hole 34 is dispose substantially rearwardly of the mid-portion hole 32.

Figure 2:
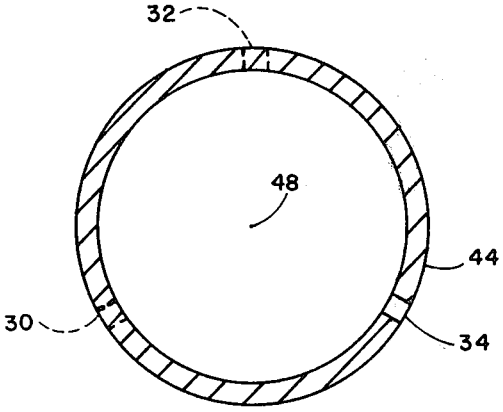
FIG. 2 is a sectional view of the shank of the arrow as seen along the line 2—2 of FIG. 1.

Referring to FIG. 2, it can be seen that the disposition of the holes 30, 32 and 34 is that they are disposed equidistantly spaced around the cylindrical exterior 44 of the shank 12. This causes the weight distribution of the arrow to be substantially balanced about an axis 48 extending along the shank and through the center thereof, as best seen in FIG. 2.

As best seen in FIG. 1, it will be seen that the hole 32 slants rearwardly toward its outer end. The holes 30 and 34 are similarly constructed.

Figure 3:
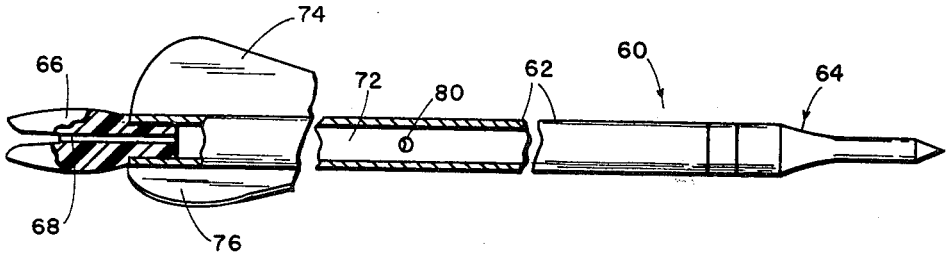
FIG. 3 is a view similar to FIG. 1 but illustrating a modification in which a rearward hole from the exterior into the shank is made through the nock, and a portion of the nock, and an adjacent portion of the shank are removed to show this, sections of the shank forward and rearward of the central hole are removed, a central hole area is shown with the closer half of the shank removed.

Referring to FIG. 3 a modification of the arrow of FIG. 1 is there shown at 60, and having a shank 62, a head 64 attached to its forward end, and a nock 66 attached to its rearward end. In FIG. 3 it can be seen that the nock 66 is provided with a hole 68 extending from the center of the rearward end of the nock forwardly to the forward end, whereby the hole 68 tends to make a passage way for blood from the hollow interior 72 of the shank 62 to the exterior.

Feathers or their substitutes can both be called stabilizers and are diagrammatically shown at 74, and 76 in FIG. 3.

In FIG. 3 a hole 80 is provided through one side of the shank and it inclines rearwardly toward its outer end, the hole 80 being at a mid-portion of the shank although the mid-portion hole need not be exactly in the center between the ends thereof, but can vary.

Figure 5:
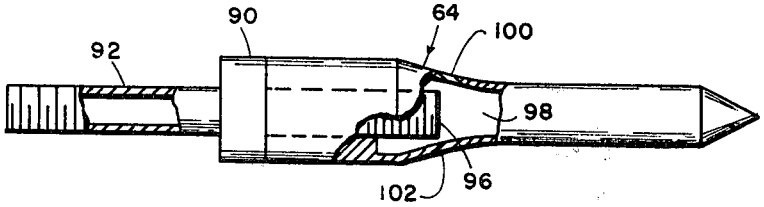
FIG. 5 is a detail showing an arrow head and adapter portion of the arrow of FIG. 3, showing holes from the exterior of the head extending to the center of a hollow in communication with a hollow adapter, portions of the head and adapter being broken away.

Referring to FIG. 5, the head 64 is shown in detail, and an adapter 90 having a threaded tubular rearward end 92 is provided for attachment of the rearward end 92 threadedly to the interior of the shank 62. The forward end of the adapter is also a threaded tubular shaped portion, seen at 96, and it threadedly attaches the adapter to the head 64, which latter is hollow.

The head 64 can have one or more holes extending from its hollow interior 98 therethrough, such holes being shown at 100, and 102. The holes 102 and 100 slant rearwardly toward their outer ends.

Figure 6:
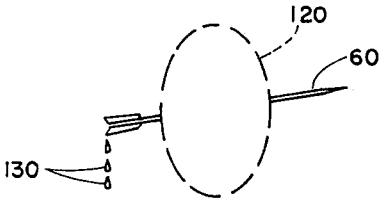
FIG. 6 is a diagrammatic showing of the body of a deer in dotted lines, with an arrow extended therethrough in a position such that the blood entering a central hole escapes out of a rearward hole of the arrow.

Referring to FIG. 6, the body of a deer is diagrammatically shown at 120 and when the arrow 60 is disposed so that its central part is in the deer, then blood will be forced by the pressure of blood in the deer's body through the aperture 80, and along the shank 62, passing out through the hole 68 in the nock. The blood dripping down therefrom is seen at 130, and would leave a trail of blood on the ground which a hunter can follow.

Figure 7:
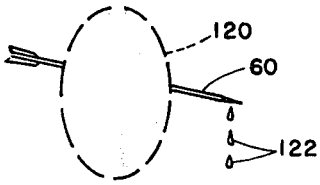
FIG. 7 is a view similar to FIG. 6, but showing a situation in which blood from a center hole of the arrow escapes from a forward hole when it is outside the deer.

In FIG. 6, the arrow inclines upwardly. In FIG. 7 an arrow is shown inclining downwardly, so that blood on the interior of the shank would drip as shown at 122 of the holes 100 and 102 at the head.

The operation of the arrow of FIG. 1 is similar to the operation of the arrow shown in FIGS. 6 and 7. It is to be understood that if the central hole 32 of the arrow of FIG. 1 is in the deer, then blood can come out either of the holes 30 or 34, which ever one or both are extended beyond the body of the deer.

Conversely, if either the arrow 10 or the arrow 60 are disposed so that only the forwardmost hole is in the body of a deer then blood can come out either of the holes rearwardly thereof. If only the rearward hole were in the body of the deer, then blood could come out either of the holes forwardly of the rearward hole.

Figure 4:
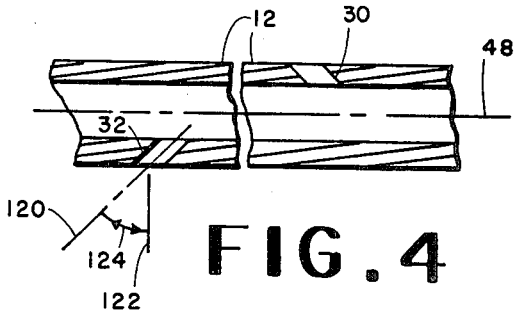
FIG. 4 is a view showing in vertical cross section two different sections of the shank, showing holes therethrough, portions of the shank between the holes being removed.

Referring to FIG. 4, the particular inclination of the side walls of a hole and of the hole axis 120 is illustrated to be 45 degrees with respect to the axis 48 extending through the shank of the arrow or with respect to a perpendicular thereto as shown at 122, such angle being indicated at 124. However, it is to be understood that the exact angle is not critical, but that a rearward inclination is vital to prevent the whistling sound which might alarm a deer. They are very quick and have excellent hearing and might escape the arrow if the holes were not inclined in this way.

I claim:

1. An arrow for blood tracking comprising an elongated tubular shank having a head at one end and a nock at its other end, said arrow having a plurality of holes extending therethrough from the exterior of said arrow, the inner ends of said holes being in communication with the interior of said shank, the walls of said holes being slanted rearwardly toward their outer ends.

2. The arrow for blood tracking of claim 1 having at least one of said holes being in a mid-portion of said shank and at least one other of said holes being substantially spaced forwardly of said mid-portion hole and another hole disposed substantially spaced rearwardly of said mid-portion hole.

3. The arrow for blood tracking of claim 1 having the weight distribution of said arrow being substantially balanced about an axis extending along said shank and through a center thereof.

4. An arrow for blood tracking comprising an elongated tubular shank having a head at one end and a nock at its other end, said shank having a plurality of holes extending therethrough from the exterior of said shank, the inner ends of said holes being in communication with the interior of said shank, the walls of substantially all of said holes being slanted rearwardly toward their outer ends for substantial elimination of whistling noise from said arrow.

* * * * *